US005954324A

United States Patent [19]

Rehberg et al.

[11] Patent Number: 5,954,324

[45] Date of Patent: Sep. 21, 1999

[54] APPARATUS INCLUDING A ROLLER FOR SHAKING AND LOOSENING FLAT ARTICLES IN A STACK FOR FACILITATING REMOVAL OF AN ARTICLE FROM THE STACK

[75] Inventors: Heinz Rehberg; Wolf Alexander Krumholz, both of Berlin; Michael Schmidt-Kretschmer, Eichwalde, all of Germany

[73] Assignee: Francotyp-Postalia AG & Co., Birkenwerder, Germany

[21] Appl. No.: 08/790,978

[22] Filed: Jan. 30, 1997

[30] Foreign Application Priority Data

Jan. 31, 1996 [DE] Germany ..... 195 05 017

[51] Int. Cl.[6] ..... B65H 5/06

[52] U.S. Cl. ..... 271/2; 271/119; 271/149

[58] Field of Search ..... 271/2, 119, 120, 271/126, 149

[56] References Cited

U.S. PATENT DOCUMENTS

| | | | |
|---|---|---|---|
| 2,764,409 | 9/1956 | Bombard . | |
| 3,406,627 | 10/1968 | Becker, III . | |
| 3,828,634 | 8/1974 | Luperti | 271/2 |
| 3,970,298 | 7/1976 | Irvine et al. . | |
| 4,305,577 | 12/1981 | Clay et al. | 271/119 |
| 4,437,658 | 3/1984 | Olson | 271/119 |
| 4,615,519 | 10/1986 | Holodnak et al. . | |
| 4,789,148 | 12/1988 | Noguchi et al. | 271/149 |
| 4,850,580 | 7/1989 | Denzin et al. | 271/2 |
| 4,973,037 | 11/1990 | Holbrook | 271/2 |
| 5,000,088 | 3/1991 | Cargill . | |
| 5,112,037 | 5/1992 | Holbrook | 271/2 |

FOREIGN PATENT DOCUMENTS 0 376 520 4/1990 European Pat. Off. .

OTHER PUBLICATIONS

"Shingle Wheel With Friction Pads," Hunt, IBM Technical Disclosure Bulletin, vol. 21, No. 12, May, 1979, p. 4750.

*Primary Examiner*—H. Grant Skaggs
*Assistant Examiner*—Patrick Mackey
*Attorney, Agent, or Firm*—Hill & Simpson

[57] ABSTRACT

In an arrangement for separation of items bearing printed matter, in particular letters deposited on edge behind one another in a letter stack, supplied laterally from the letter stack to a separation apparatus and then to a subsequent apparatus such as a postage meter machine, a pre-separation stage is provided before the separation apparatus. The letters are arranged between a spring-mounted pressure clip and a drive roller, as well as a guide plate. The pre-separation stage loosens the letter stack and permits a simple, reliable letter-by-letter separation of the letters from the letter stack. The pre-separation stage includes at least one drive roller having an outer contour with at least one projection extending over the length of the roller parallel to its axis of rotation. The curve of the jacket of the drive roller protrudes through the opening of the guide plate far enough so that at least one projection protrudes from the opening. Due to the protruding outer contour, the letter stack is sufficiently shaken, and the frictional forces and forces of adhesion that work counter to the transport forces are overcome. The force applied to the letter stack in the pre-separation stage can be adjusted by adjusting the lift of the drive roller on the letter stack.

13 Claims, 1 Drawing Sheet

FIG. 3
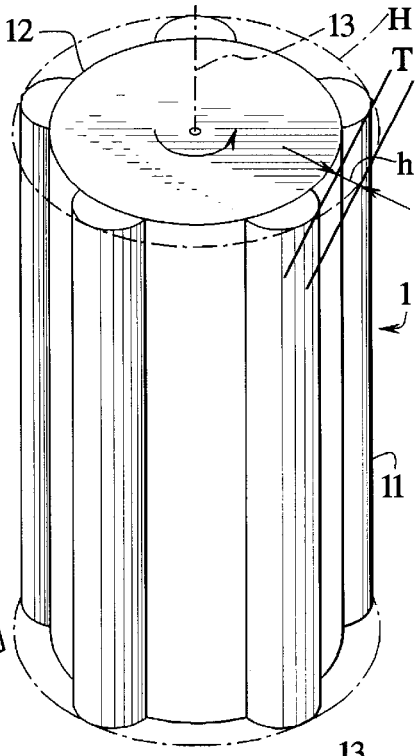
FIG. 1
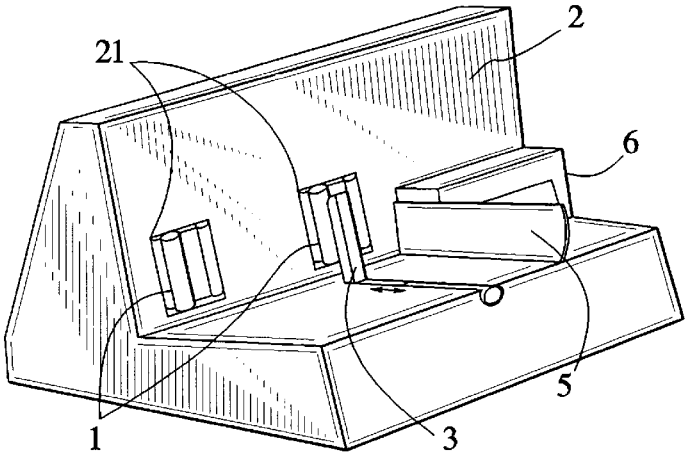
FIG. 2
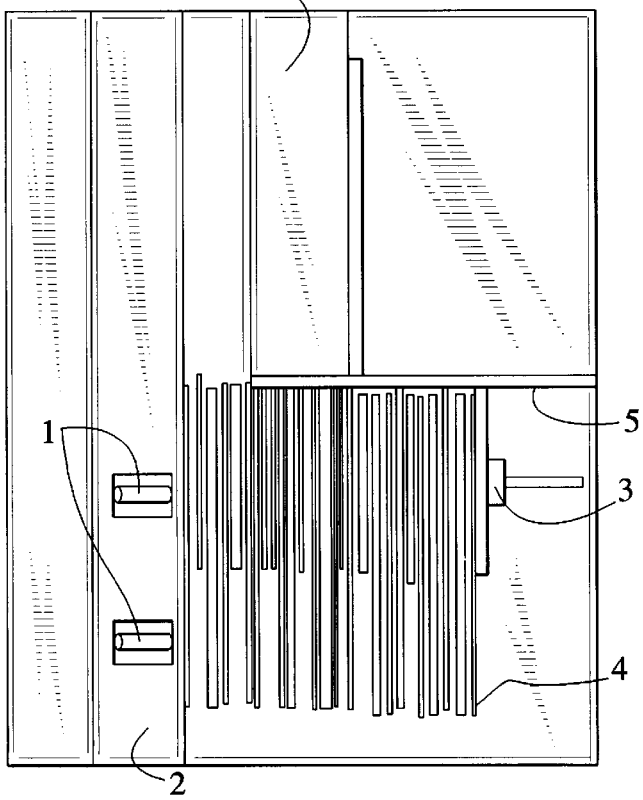
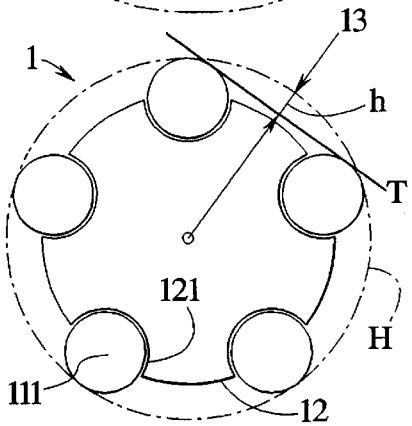
FIG. 4
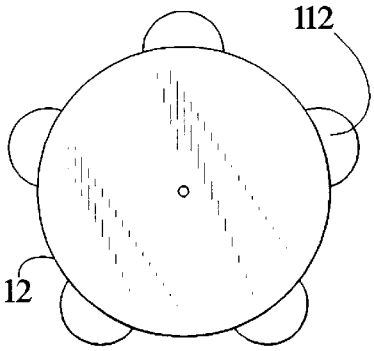
FIG. 5

APPARATUS INCLUDING A ROLLER FOR SHAKING AND LOOSENING FLAT ARTICLES IN A STACK FOR FACILITATING REMOVAL OF AN ARTICLE FROM THE STACK

BACKGROUND OF THE INVENTION

1. Field of the Invention

The present invention is directed to an apparatus for separating items bearing printed matter, and in particular to an apparatus for separating letters in a letter stack so that letters can be removed from the stack, one at a time, for supply to a franking apparatus such as a postage meter.

2. Description of the Prior Art

It is often necessary to separate an item from a group of items bearing printed matter, in particular letters (envelopes). Such items are often arranged on edge behind one another as in a stack, and are supplied laterally from the stack to a separating apparatus and thereafter to a subsequent apparatus, such as a postage meter machine. The items such as letters generally lie either over one another or behind one another, and can have different thicknesses, as well as an irregular sequence of the allowable sizes. The processing of letters deposited in this way is called mixed post operation.

The forces which hinder transport of the items are hard to control in such a system, since in particular the application of force onto the letter stack (such as to maintain the stack somewhat compressed) cannot be larger than the force applied by the transport means or the guides of the subsequent apparatus on the individual letter to remove it from the stack. Thus, with a different distribution of forces letters are no longer guided, but are overly compressed and get jammed in the apparatus.

As described in European Application 376 520, conveying letters standing vertically or an edge thereof has advantages over conveying letters lying flat because the letter weights operating on the stack are smaller, and thus lower forces are required to overcome the forces of friction and forces of attraction between the letters. Moreover, for the letters standing on edge exhibit a self-orientation in relation to this edge due to the force of gravity.

An apparatus for separating postal items deposited on edge behind one another as a letter stack in a receptacle area, is described, for example, in U.S. Pat. No. 4,615,519. The letter stack is pressed against a pull-off apparatus by means of spring force applied by a pushing element guided on a carrier. The pull-off apparatus has a drive roller made of rubber plates arranged spaced from one another on an axis. A part of the roller body protrudes over a guide plate that lies opposite the receptacle area, and that also lies flat on the letter-side surface of the foremost letter of a stack. The guide plate engages, in toothed fashion, into the gaps between the rubber plates. There is an approximately constant pressure between the letter stack and the drive roller, due to the spring force. It is problematic, however, to introduce a force between the drive roller and the foremost letter that overcomes the adhesion between this letter and the letter stack, as well as between the letter and the guide plate, especially since the adhesive force can exhibit very large letter-to-letter differences, due to different weights and adhesive properties of surfaces, as well as the condition of the paper. If the drive roller slips, disturbances in the automatic operation result.

In the apparatus disclosed in U.S. Pat. No. 3,970,298, two toothed belts rotating vertically at a distance over one another between two rollers are used as a pull-off apparatus.

The postal items, deposited on edge and unsorted in a magazine, are pressed against a manually adjustable stop plate by a spring-mounted pressure plate, this stop plate being arranged between the toothed belts for the support of the letter stack. On each belt, two pads are fastened in a displaced manner, oriented in a pair, which are made of a material with a relatively high friction coefficient. These pads serve to carry the letters along. During operation, there first ensues, by means of the first pair of pads, an application of force onto the letter stack, in order to separate the foremost letter from the stack and draw it forward in such a way that the rear edge of the letter drawn forward in the transport means comes into the area of the stop plate. As the belt continues to move, the second pair of pads in turn draws a letter forward, and at the same time the letter lying on the stop plate is gripped at its edge by the beveled side surfaces of the pads, and is pushed into the separating apparatus.

A disadvantage of this approach is that the introduction of forces via the edge of the letter can lead to bulging, creasing, breaking or jamming of the letter in the subsequent apparatus, and automatic operation is thus not ensured. Moreover, there is a risk of rapid wear of the pads.

SUMMARY OF THE INVENTION

An object of the present invention is to increase the operational reliability of a separating apparatus for items bearing printed matter.

More specifically, it is an object of the invention to provide a separating arrangement with which a letter stack is loosened so that the successive letters can be pulled off the stack easily and reliably.

The above object is achieved in accordance with the principles of the present invention in an apparatus for separating printed matter carriers, such as letters, deposited on edge in a stack for supply to another apparatus, such as a postage meter, wherein a pre-separation stage is provided. The pre-separation stage includes a guide plate, against which the stack is pressed by a spring-mounted pressure applicator, and a drive roller. The drive roller has an outer contour with at least one projection which extends along a length of the drive roller parallel to its axis of rotation. When the drive roller is rotated, the outermost surface of the projection defines a cylindrical jacket surface, and the drive roller is mounted so that this cylindrical jacket surface protrudes through an opening in the guide plate, with the axis of rotation of the drive roller being parallel to the guide plate. The guide plate may be disposed at an angle relative to the horizontal, in which case the axis of rotation is also inclined.

With the inventive separating apparatus, continuous shaking of a letter stack formed by a number of letters standing upright behind one another, of various thicknesses and sizes, achieves a pre-separation of the letters, thereby achieving reliable letter-by-letter removal from the stack. A pressure clip presses constantly against the letter stack deposited between the guide plate and the pressure clip. During operation, the eccentric projections of the drive roller press against the adjacent surface of the letter stack, shaking the stack and simultaneously separating letters from the deposited letter stack. The frictional and adhesive forces are minimized by the shaking of the stack. The forces applied for overcoming the frictional forces, which may potentially hinder transport between the letter stack and the guide plate, and the forces between the letters can be adjusted by means of the lift of the drive roller.

A maximum lift results from the distance between a tangent for adjacent projections and the jacket surface (i.e., the outer circumferential surface, including the projections) of the drive roller. It is useful to distribute the projections uniformly over the circumference of the drive roller. Other adjustments, such as a thickness and size matching, as well as a pre-sorting of the letters, are not required.

A further drive roller can be arranged in the guide plate in order to achieve a better shaking for large-sized letters, in order better to overcome the effective frictional and adhesive forces. With the use of more than one drive roller, a synchronous operation of the drive rollers is set, so that the projections of the respective rollers simultaneously transmit mechanical impulses to the letter stack.

A stable preferred position of the letter stack is achieved by means of the inclination of the guide plate. Of course, the axis of the drive roller is parallel to the guide plate.

DESCRIPTION OF THE DRAWINGS

FIG. 1 is a perspective representation of a separating module with a pre-separation stage, constructed in accordance with the principles of the present invention.

FIG. 2 is a top view of the separating module with a pre-separation stage of FIG. 1.

FIG. 3 is a perspective representation of the drive roller in the apparatus of FIG. 1.

FIG. 4 is a cross-section of the drive roller of FIG. 3, with recesses for cylindrical machined parts, and a representation of the lift therefor.

FIG. 5 is a cross-section of the drive roller of FIG. 3 with attached machined parts.

DESCRIPTION OF THE PREFERRED EMBODIMENTS

FIG. 1 shows a perspective view of an inventive arrangement.

In this arrangement a letter stack is deposited on edge in the loading area bordered by a stop plate 5, between a pressure clip 3 and a guide plate 2.

The pressure clip 3 protrudes from the base, and is arranged opposite a drive roller 1, parallel to the guide plate 2. In a recess in the base, the pressure clip 3 is guided in a spring-loaded manner, and can be moved in the directions indicated by the arrows. The pressure clip 3 constantly presses the letter stack against the drive roller 1, in the direction of the guide plate 2. The normal force between the drive roller 1 and the foremost letter is thereby increased, so that the letter stack can settle and always lies against the drive roller 1. The influence of the pressure clip 3 depends on the dead weight of the letter stack. Thus, in the case of many thick letters the influence of the pressure clip 3 on the normal force is lower, while if many thin letters lie against the drive roller 1, the influence is greater. The pressure force is produced by a spring, which must be adjusted so that the letter stack can settle without building up excessive frictional forces between the guide plate 2 and the letter stack. It is advantageous to construct the surface of the pressure clip 3 facing the drive roller 1 such that this surface is matched to the curve of the roller jacket, in order to ensure carrying along of a last thin letter, if necessary.

The drive roller 1 protrudes through an opening 21 of the guide plate 2, and is provided with at least one projection 11 located on the outer contour of the drive roller (see also FIG. 4). The drive roller 1 and the pressure clip 3 operate together such that by means of the projecting outer contour a sufficient force is introduced, in impulse fashion, on a letter stack lying in between, so as to overcome the frictional and adhesive forces working in opposition to the transport forces. The drive roller 1 shakes the letter stack and supplies letters to the separating apparatus 6, which supplies the letters individually to a subsequently connected apparatus, e.g. a postage meter machine.

The base on which the letters are deposited is inclined downwardly in the direction of the guide plate 2, and the guide plate 2 is also inclined obliquely rearwardly, preferably 18° out of plumb. The letter stack can thereby be held in a stable position.

An advantageous embodiment concerns the pre-separation of large-size letters with a weight up to 1000 gm, using two spaced drive rollers 1. The distance between the openings 21 in the guide plate 2, through which the drive rollers 1 protrude, is selected so that, before the letter is pre-separated, both drive rollers 1 are in contact with the letter surface of any large-sized letter with the allowable size range. The effective surfaces of the synchronously rotating drive rollers 1 are always arranged so that they are identical in contour and parallel in contour, in order to compensate the larger frictional forces that occur with large-size letters between the guide plate 2 and the letter stack, by means of the parallel application of forces. Since the operating principle is identical for the two drive rollers 1, even a large-sized letter is lifted almost completely from the guide plate 2, and the letter stack is sufficiently shaken to achieve an easy separation and a reliable transport to the separation apparatus 6.

FIG. 2 shows the top view of the inventive arrangement with a deposited letter stack 4.

The letter stack 4 is formed from a number of unsorted mixed postal items, which differ in size, thickness and weight. The stop plate 5 borders the loading area for the letter stack 4 in the pull-off (removal) direction, and forms a stop edge for the approximately lateral orientation of the letters. The guide plate 2 supports the letter stack 4 toward the front, and holds the letter stack 4 in the stable preferred position, supported by the spring-mounted pressure clip 3, which presses the letter stack 4 against the guide plate 2. By means of the drive rollers 1, the letters are pre-separated and guided along a path to a separating apparatus 6.

As shown in FIG. 3, the drive roller 1 is formed by a basic element 12, having an outer contour with at least one projection 11 extending over the length of the roller. The projection 11 protrudes beyond the basic element 12 and is arranged parallel to the axis of rotation 13. The projections 11 protrude entirely or partially from the openings 21 in the guide plate 1, shown in FIG. 1.

During motion, the projections 11 transmit mechanical impulses to the letter stack and shake it. At the same time, at least the foremost letter is grasped by the projections 11 rotating about the axis of rotation 13, and is moved laterally to the supply path for the separation. The force applied on the letter stack can be adjusted via the lift that can be exerted by the drive roller 1 in the direction of the letter stack. The maximum lift corresponds to the distance h between the tangent T over two adjacent projections 11 to the jacket surface H of the drive roller 1.

In order better to overcome the frictional forces, materials or surfaces for the projections 11 are preferably chosen that permit an optimal carrying of the letter. A polyurethane material is particularly suitable. For example, given a coating with too low a coefficient of friction, a slipping effect can occur, which does not ensure reliable transporting. If the coefficient of friction is chosen too large, members of the stack are indeed reliably transported, but with such a large force being required that the letters can get stuck in the separating apparatus. It is advantageous to arrange projections 11 so as to be exchangeable.

FIG. 4 shows an inventive drive roller with recesses for cylindrical machined parts.

Recesses 121 in the shape of cylindrical segments, larger than a half cylinder, are machined into the cylindrical basic element 13 of the drive roller 1. Cylindrical machined parts 111 are pushed into these recesses so as to be held positively or non-positively therein. The machined parts 111 are preferably to be arranged so as to be distributed with uniform spacing on the circumference of the basic element 13. The geometrical form of the machined parts 111 is not limited to these embodiments; various geometrical products can be used, which advantageously should not have a sharp contour at the contact surfaces.

FIG. 5 shows a further construction wherein projections are attached on the outer contour of the drive roller. Uniformly spaced machined parts 112 in the shape of cylindrical segments, attached with axes in parallel, are fastened on the basic element 12.

Although modifications and changes may be suggested by those skilled in the art, it is the intention of the inventors to embody within the patent warranted hereon all changes and modifications as reasonably and properly come within the scope of their contribution to the art.

We claim as our invention:

1. In an apparatus for separating envelopes each having a face surrounded by edges and arranged on an edge behind one another in a stack, for individual removal, along a removal direction, of letters from said stack for supply to a subsequent apparatus, said apparatus having a guide plate against which said stack is disposed the improvement of a pre-separation stage comprising:

a drive roller having an axis of rotation parallel to the respective faces of the envelopes in said stack and perpendicular to said removal direction, and having an outer surface;

at least one projection on said outer surface of said drive roller extending along a length of said drive roller parallel to said axis of rotation, said at least one projection having an outermost surface which, when said drive roller is rotated, defines a cylindrical jacket surface;

a pressure-applying means for urging said stack against said guide plate; and said drive roller being mounted with said cylindrical jacket surface protruding through an opening in said guide plate into contact with a face of a drive roller-adjacent envelope in said stack, with said axis of rotation parallel to said guide plate, said drive roller shaking the envelopes in said stack and loosening the envelopes in said stack from each other and removing said drive roller-adjacent envelope from said stack.

2. The improvement of claim 1 wherein said guide plate is disposed at a non-perpendicular angle relative to the horizontal, and wherein said drive roller is mounted with said axis of rotation inclined at said non-perpendicular angle.

3. The improvement of claim 1 comprising a plurality of projections mounted on said drive roller, said projections being disposed on said outer surface with a distance between adjacent projections so that a spacing between a tangent, extending between any two adjacent projections, and said cylindrical jacket surface is equal to a maximum lift given to said stack by said drive roller.

4. The improvement of claim 1 wherein said drive roller comprises a first drive roller, and the improvement further comprising a second drive roller, identical to said first drive roller, extending through a further opening in said guide plate spaced from said first drive roller.

5. The improvement of claim 1 wherein said drive roller comprises a plurality of projections distributed uniformly over said outer surface, each projection having a rounded exterior.

6. The improvement of claim 1 wherein said drive roller comprises a cylindrical base element having a plurality of recesses in said outer surface, each recess forming more than one-half of a cylindrical surface extending toward said axis of rotation into said base element and each recess having an axis parallel to said axis of rotation, and a plurality of cylindrical elements respectively disposed in said recesses and projecting beyond said outer surface of said base element to form said projections.

7. The improvement of claim 6 wherein said cylindrical elements are comprised of a material having a high coefficient of friction.

8. The improvement of claim 7 wherein said cylindrical elements are comprised of polyurethane.

9. The improvement of claim 1 wherein said drive roller comprises a cylindrical base element, and a plurality of partial, cylinder segments attached on said outer surface, each segment having an axis parallel to said axis of rotation.

10. The improvement of claim 9 wherein said segments are glued on said outer surface of said base element.

11. The improvement of claim 9 wherein said segments are comprised of a material having a high coefficient of friction.

12. The improvement of claim 11 wherein said segments are comprised of polyurethane.

13. The improvement of claim 1 wherein said pressure-applying means comprises a pressure clip having a curve matched to a curve of said cylindrical jacket surface.

* * * * *

UNITED STATES PATENT AND TRADEMARK OFFICE

CERTIFICATE OF CORRECTION

PATENT NO. : 5,954,324

DATED : September 21, 1999

INVENTOR(S) : Heinz Rehberg et al

It is certified that error appears in the above-identified patent and that said Letters Patent is hereby corrected as shown below:

On the title page, in the "Foreign Application Priority Data" change "195 05 017" to --196 05 017--.

Signed and Sealed this

Twenty-fifth Day of April, 2000

*Attest:*

Q. TODD DICKINSON

*Attesting Officer*

*Director of Patents and Trademarks*